US008480351B2

(12) United States Patent
Wang et al.

(10) Patent No.: US 8,480,351 B2
(45) Date of Patent: Jul. 9, 2013

(54) COMPRESSOR UNIT

(75) Inventors: Hang Wang, Hengyang (CN); Yanzhao Li, Shouguang (CN); Xilu Guo, Shouguang (CN); Hengxing Yang, Shouguang (CN); Xiaowei Guo, Shouguang (CN); Zhifu Zhu, Beijing (CN); Jinyu Yang, Shouguang (CN)

(73) Assignee: Kangyue Technology Co., Ltd., Shouguang (CN)

( * ) Notice: Subject to any disclaimer, the term of this patent is extended or adjusted under 35 U.S.C. 154(b) by 0 days.

(21) Appl. No.: 13/371,492

(22) Filed: Feb. 13, 2012

(65) Prior Publication Data

US 2012/0141263 A1 Jun. 7, 2012

Related U.S. Application Data

(63) Continuation of application No. PCT/CN2009/074331, filed on Sep. 30, 2009.

(30) Foreign Application Priority Data

Aug. 13, 2009 (CN) ..... 2009 1 0017618

(51) Int. Cl.
*F04D 13/12* (2006.01)

(52) U.S. Cl.
USPC ..... 415/68; 415/143

(58) Field of Classification Search
USPC ..... 416/185, 188, 182, 174; 415/224.5, 415/228, 172.1, 142, 66, 67, 68, 69, 143
See application file for complete search history.

(56) References Cited

U.S. PATENT DOCUMENTS 4,449,888 A * 5/1984 Balje ..... 415/143

* cited by examiner

*Primary Examiner* — Richard Edgar
(74) *Attorney, Agent, or Firm* — Matthias Scholl P.C.; Matthias Scholl

(57) ABSTRACT

A compressor unit including a compressor housing, a compressor impeller, a gas diffuser channel, a cylinder-shaped rotating diffuser wall, and a supporting device. The compressor housing includes an air inlet and an air collection channel. The compressor impeller is installed in the compressor housing. The gas diffuser channel is disposed between the compressor impeller and the air collection channel and connected to the air collection channel. The cylinder-shaped rotating diffuser wall is disposed between an inner wall of the compressor housing and the compressor impeller and rotates in the same direction as the compressor impeller. The supporting device is disposed in the compressor housing to support the cylinder-shaped rotating diffuser wall. The compressor unit has high response speed, large air inlet flow, and high efficiency.

16 Claims, 9 Drawing Sheets

COMPRESSOR UNIT

CROSS-REFERENCE TO RELATED APPLICATIONS

This application is a continuation of International Patent Application No. PCT/CN2009/074331 with an international filing date of Sep. 30, 2009, designating the United States, now pending, and further claims priority benefits to Chinese Patent Application No. 200910017618.8 filed Aug. 13, 2009. The contents of all of the aforementioned applications, including any intervening amendments thereto, are incorporated herein by reference.

BACKGROUND OF THE INVENTION

1. Field of the Invention

The invention relates to a supercharged device for internal combustion engines, and more particularly to a compressor unit used for a turbocharger.

2. Description of the Related Art

In recent years, with the substantial increase of the engine power, the compression ratio of the turbocharger is rising. But under the constraints of the turbocharger structure, a number of new industries problems are encountered at the supercharger efficiency of the turbocharger compressor. Under the condition of the high compression ratio, the flow friction losses at the side of the turbocharger and the gap loss during rotation of the compressor blades have more and more restricted the increase of the turbocharger efficiency. With the rising speed of the turbocharger, the relative inlet speed and angle of the leading edge of the compressor impeller are increasing, which constrains the air flow of the turbocharger, and the matching of the supercharger and the engine is more difficult.

As shown in FIG. 1, the compressor section of a turbocharger includes three parts: a compressor housing 1, a compressor impeller 4, and a gas diffuser channel 5. During normal operation, with the drive of a turbine shaft 12, the compressor impeller 4 is high-speed rotating to compress centrifugally the clean air inhaled from an air inlet 2. When the high-speed compressed gas enters into the gas diffuser channel 5 from the exit of the compressor impeller, the kinetic energy begins to transform into the pressure energy. While the gas enters an air collection channel 3 of the compressor housing under the constraint of the gas diffuser channel 5, and then enters the engine combustion chamber for combustion through the piping connected to the outlet side of the compressor housing 1. When the pressurized air flows in the gas diffuser channel 5, a diffuser channel wall 51 and a connection plate diffuser wall 11 perform the radial constraint of the air, during which the friction is produced and reduces the compressor efficiency.

To meet the acceleration and response requirements of engines, the turbochargers need the rotation speed of tens of thousands per minute, hundreds of thousands per minute or even higher. Limited by the structure and layout of the turbocharger compressor, a gap a1 must be retained between an outer contour surface 41 of the compressor impeller 4 and an inner contour surface of the compressor housing 1, to ensure no friction between them and to avoid turbocharger failure under the high-speed rotation of the compressor impeller 4. To ensure reliable operation, the gap a1 is generally about 0.4-0.8 mm, which is about 4%-8% of the height of the inlet leading edge 9 of the impeller. The gas inhaled from the inlet leading edge 9 of the impeller into the compressor impeller 4 is centrifugally compressed and flows along the hub contour of the impeller and the inner contour surface of the compressor housing 1. During the compression process, the gas turbulence in the gap a1 between the inner contour surface of the compressor housing 1 and the outer contour surface 41 leads to the rapid decline of the compressor efficiency. Therefore, the gap a1 should be as small as possible, up to the zero-clearance state for the high-efficient compression.

To increase the compressor flow, a compressor structure with dual inlet channels is used on the turbocharger. As shown in FIG. 2, there are an air inlet 2 and an inlet 14 of a compressor outflow channel at the inlet end of the compressor housing 1. One end of the inlet 14 of the compressor outflow channel is connected to a supplement air intake groove 13. When the compressor impeller 4 is high-speed rotating driven by the turbine shaft 12, and the intake of the air from the impeller inlet leading edge 9 is restricted, part of air enters from the supplement air intake groove 13 to increase the flow. In the low-speed condition, it has played a certain role to restrain the turbocharger surge. But the compressor structure with dual-channels is a simple intake regulation device, with a limit for the improvement degree, and the presence of the supplement air intake groove 13 has created an additional space losses and an aerodynamic noise.

Thus, an advanced compressor device is required to solve the problem of the turbocharger efficiency, to solve the scratching shell failure after the turbocharger is worn, and to extend the turbocharger life, as well as to further increase the compressor flow and the pressure ratio.

SUMMARY OF THE INVENTION

In view of the above-described problems, it is one objective of the invention to provide a compressor unit comprising an adjustable rotating diffuser wall with high efficiency and broaden inlet flow.

To achieve the above objective, in accordance with one embodiment of the invention, there is provided a compressor unit comprising a compressor housing, a compressor impeller, a gas diffuser channel, a cylinder-shaped rotating diffuser wall, and a supporting device, wherein the compressor housing comprises an air inlet and an air collection channel, the compressor impeller is installed in the compressor housing, the gas diffuser channel is disposed between the compressor impeller and the air collection channel and connected to the air collection channel, the cylinder-shaped rotating diffuser wall is disposed between an inner wall of the compressor housing and the compressor impeller and has the same rotation direction as the compressor impeller, and the supporting device is disposed in the compressor housing to support the cylinder-shaped rotating diffuser wall.

In a class of this embodiment, the rotating diffuser wall comprises a straight-shaped guide section and a horn-shaped diffuser section, and the guide section is connected to the supporting device at the end of the air inlet.

In a class of this embodiment, on the inner surface of the diffuser section disposed is an inner circumference surface fitted with the diffuser wall, and the compressor impeller comprises an outer contour surface. There is a gap of less than 0.4 mm between the inner circumference surface fitted with the diffuser wall and the outer contour surface of the compressor impeller.

In a class of this embodiment, on the outer surface of the diffuser section disposed is an outer circumference surface fitted with the diffuser wall. There is a gap of less than 0.5 mm between the outer circumference surface fitted with the diffuser wall and an inner wall of the compressor housing.

In a class of this embodiment, at the side close to the diffuser section, the gas diffuser channel is disposed with a diffuser channel wall, and a circular groove is disposed on the diffuser channel wall. The diameter of the outer circumference surface of the rotating diffuser wall is largest at the biggest opening of the diffuser section. The largest outer circumference surface is located in the circular groove and forms a smooth transition surface with the diffuser channel wall of the gas diffuser channel.

In a class of this embodiment, the diameter of the largest outer circumference surface of the rotating diffuser wall is 1.05-1.5 times the largest diameter of the compressor impeller.

In a class of this embodiment, the maximum opening end of the diffuser section extends to the air collection channel along the air diffuser channel, and there is the circumferential surface with the maximum diameter of the diffuser vane at maximum opening end of the diffuser section. The diffuser channel wall is located near the air intake side of the air diffuser channel, and the circumferential surface with maximum diameter of the guide vane diffuser wall is greater than the outer diameter of the diffuser channel wall.

In a class of this embodiment, the outer circumferential surface diameter of the guide vane diffuser wall is 1.4-2 times the diameter of the compressor impeller.

In a class of this embodiment, the supporting device comprises a support plate fitted with an inner wall of the inlet, a hub of the support plate is located at the center of the support plate, a connection shaft is fitted in the hub of the support plate, and a support rib plate is fitted between the support plate and its hub.

In a class of this embodiment, an intake supporting device connected with the connection shaft is located in the guide section at the distal end to the diffuser section.

In a class of this embodiment, the intake supporting device comprises a hub of the diffuser wall at the central axis of the guide section. The hub of the diffuser wall is fixed and installed in the connection shaft, and an air conditioning device is located between the hub of the diffuser wall and the inner wall of the guide section.

In a class of this embodiment, the air conditioning device is a support rib plate of the diffuser wall distributed uniformly in the circumference of the hub of the diffuser wall.

In a class of this embodiment, the intake supporting device comprises a hub of the guide vane diffuser wall at the axis center of the guide section, the hub of the guide vane diffuser wall is installed on the connection shaft, and a guide vane air conditioning device is located between the hub of the guide vane diffuser wall and the inner wall of the guide section.

In a class of this embodiment, the guide vane air conditioning device comprises a plurality of vortex-like diffuser vanes, which are evenly distributed in the circumference of the hub of the guide vane diffuser wall.

In a class of this embodiment, the guide vane air conditioning device comprises a plurality of moving guide vanes and static guide vanes, the moving vanes are installed between the hub of the vane diffuser wall and the inner wall of the guide section, and the static guide vanes are installed between the support plate and its hub.

In a class of this embodiment, the moving guide vanes comprise inlet leading edges and outlet trailing edges, the outlet trailing edges are level set along the axis direction, and the inlet leading edges are bending set along the rotation direction.

In a class of this embodiment, the static guide vanes comprise inlet leading edges and outlet trailing edges, the inlet trailing edges are level set along the axis direction, and the outlet leading edges are bending set with the opposite bending direction of the inlet leading edges of the moving guide vanes.

Advantages of the invention are summarized below:

The design and development of the rotating diffuser wall installed on the compressor unit has effectively solved the problems of the low compression efficiency with the current turbocharger impeller and the big gap of the compressor. The gas friction loss has reduced by the rotating diffuser wall instead of the conventional fixed diffuser wall. The response speed and the air inlet flow of the rotating diffuser wall have been increased by the installation of guide vane on the front of the rotating diffuser wall.

Targeting at the compressor structure of the present turbocharger, the invention has adopted the split type diffuser wall to achieve the effective use of the intake air flow, and at the same time, it has solved the gap problem between the compressor impeller and the compressor housing to further improve the compressor efficiency.

In summary, the use of the adjustable compressor unit with a rotating diffuser wall has effectively improved the aerodynamic performance of the turbocharger compressor, has improved the compressor efficiency and has expanded the compressor flow, at the same time, it has also effective solved the big gap problem between the compressor impeller and the compressor housing, which can induce the problems of lower compressor efficiency and reliability. So it can meet the future demand for the high-efficient compressor.

BRIEF DESCRIPTION OF THE DRAWINGS

The following is the detailed description for the invention combined the figures and examples.

Figure 1:
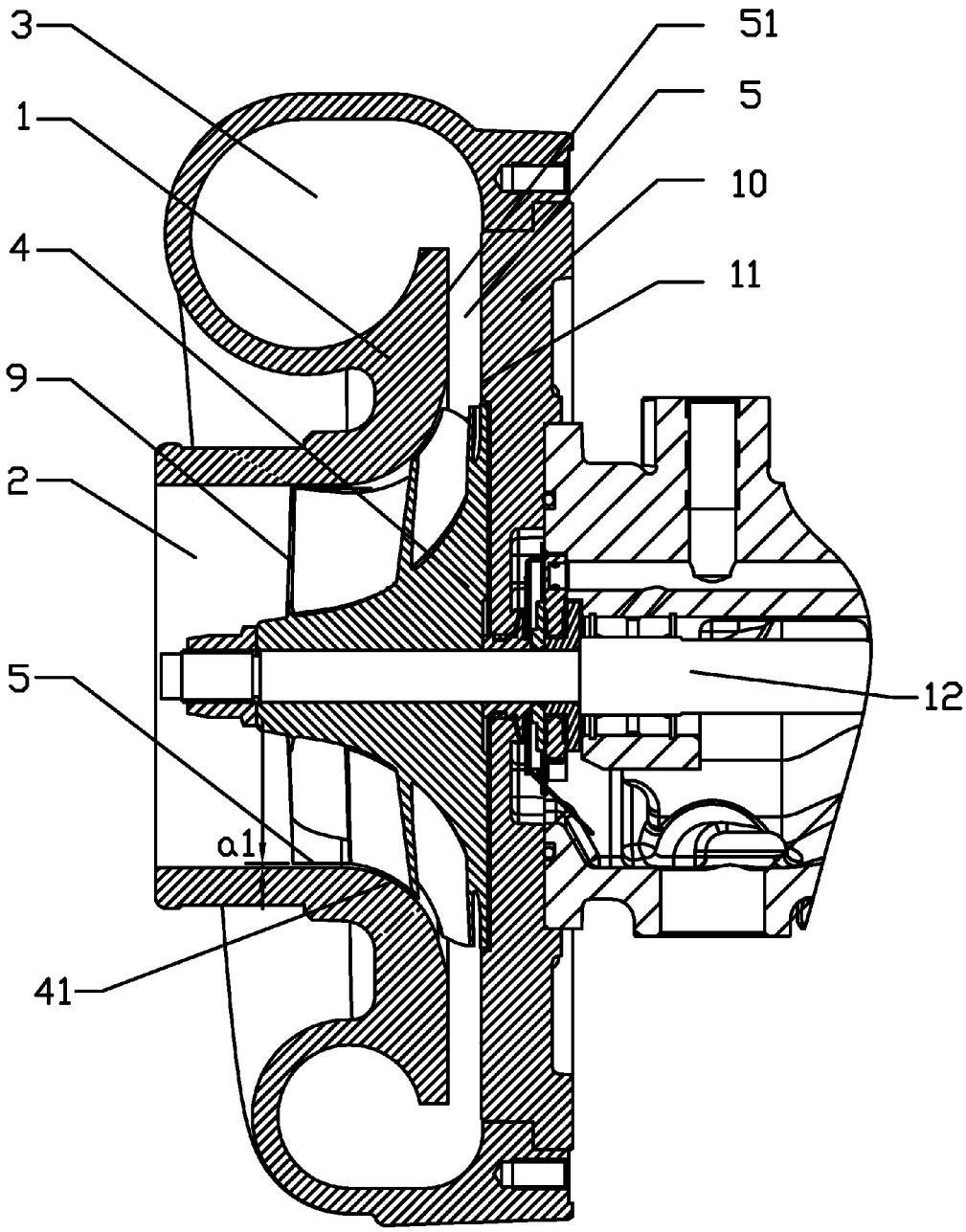
FIG. 1 is a schematic diagram of a compressor unit of a turbocharger in the art.
Figure 2:
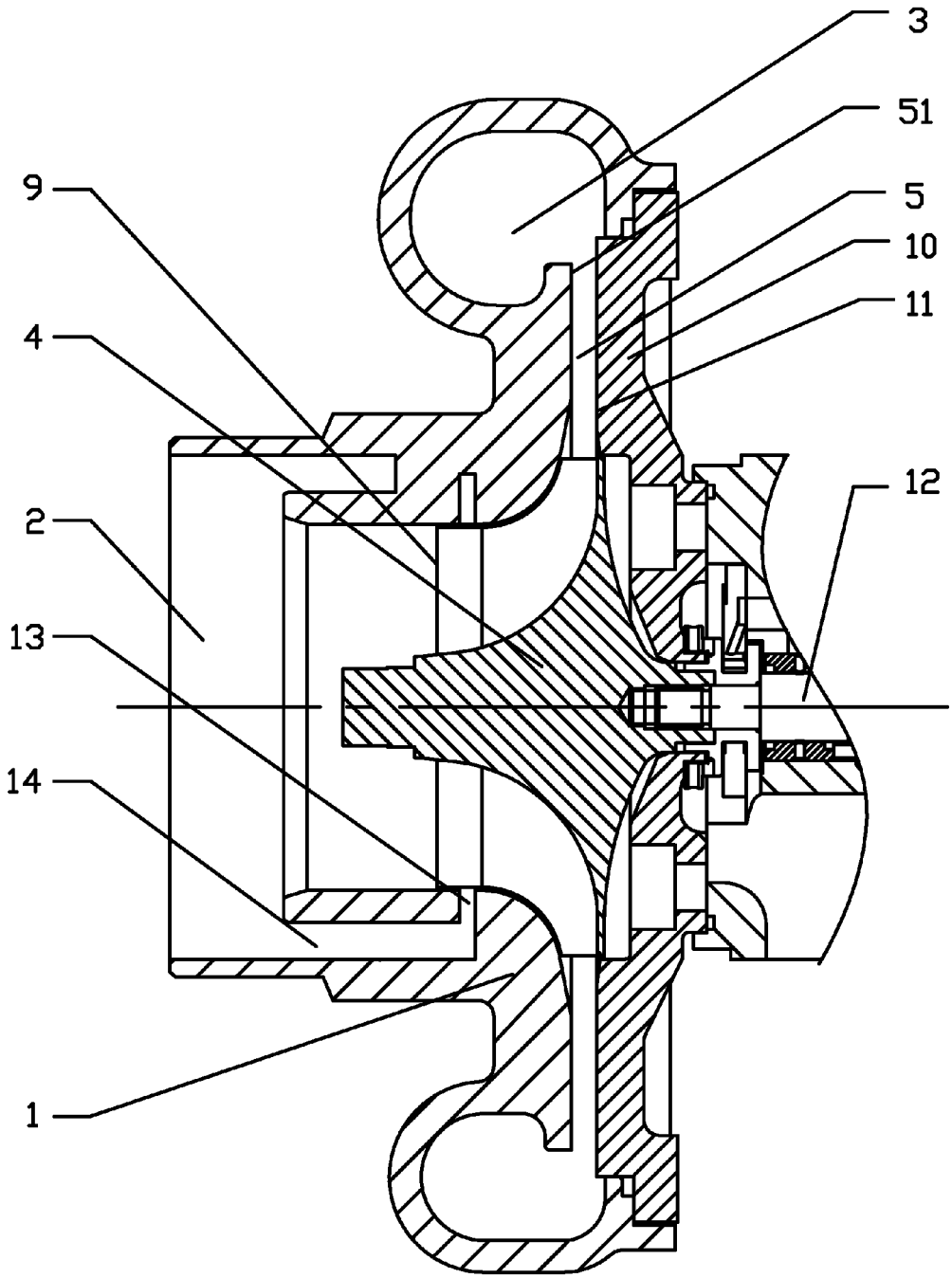
FIG. 2 is a schematic diagram of a compressor unit of a turbocharger with dual-channel in the art.

In the drawings, the following reference numbers are used: 1—Compressor housing, 2—Air inlet, 3—Air collection channel, 4—Compressor impeller, 41—Outer contour surface of impeller, 5—Gas diffuser channel, 51—Diffuser channel wall, 52—Circular groove, 6—Rotating diffuser wall, 61—Guide section, 62—Diffuser section, 63—Inner circumference surface of diffuser wall, 64—Outer circumference surface of diffuser wall, 65—Maximum outer circumference surface of diffuser wall, 66—Maximum outer circumference surface of guide vane diffuser wall, 67—Hub of diffuser wall, 68—Support rib of diffuser wall, 69—Hub of guide vane diffuser wall, 60—Guide vane of diffuser wall, 7—Support plate, 71—Hub of support plate, 72—Connection shaft, 73—Support rib plate, 81—Moving guide vane, 82—Static guide vane, 9—Inlet leading edge of impeller, 10—Connection plate, 11—Connection plate diffuser wall,

12—Turbine shaft, 13—Supplement air intake groove e, 14—Inlet of compressor outflow channel, 15—Ring, 16—Locking nut, 17—Bearing, 18—Seal ring, 19—Seal groove, a1—Gap between outer contour surface of impeller and inner contour surface of compressor housing, b1—Gap between outer contour surface of impeller and inner circumference surface of diffuser wall.

DETAILED DESCRIPTION OF THE EMBODIMENTS

Example 1

Figure 3:
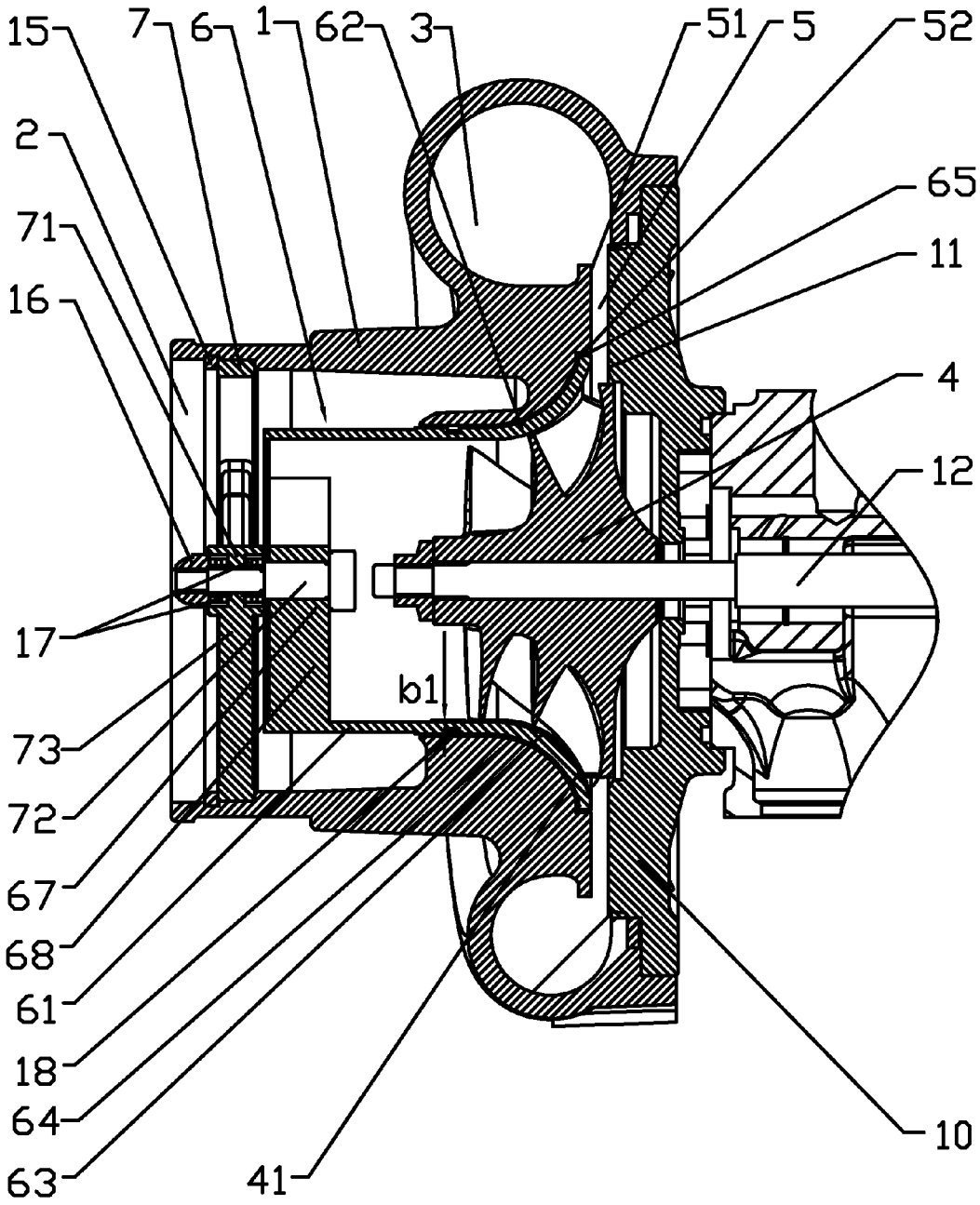
FIG. 3 is a schematic diagram of a compressor unit of a turbocharger of Example 1 of the invention.

As shown in FIG. 3, a compressor unit comprises a compressor housing 1 with an air inlet 2 and an air collection channel 3, a compressor impeller 4 is installed inside the compressor housing 1 and connected to a connection plate 10 via a turbine shaft 12, and the connection plate 10 is connected with the compressor housing 1.

An air diffuser channel 5 connected with the air collection channel 3 is located between the compressor impeller 4 and the air collection channel 3. A cylinder-shaped rotating diffuser wall 6 with the same rotation direction as the compressor impeller 4 is located between the inner wall of the compressor housing 1 and the compressor impeller 4. The supporting device for the rotating diffuser wall 6 is located in the compressor housing 1.

The supporting device comprises a support plate 7 matching with the inner wall of the air inlet 2. A hub of the support plate 71 is located at the center of the support plate 7, the connection shaft 72 is installed in the hub of the support plate 71, and the support rib 73 is located between the support plate 7 and the hub of the support plate 71.

An air intake supporting device connected with the connection shaft 72 is located at the distal end of the diffuser section 62 in the guide section 61 and comprises a hub 67 of the diffuser wall at the axis center of the guide section 61. The hub 67 of the diffuser wall is fixed on the connection shaft 72. An air conditioning device is disposed between the hub 67 of the diffuser wall and the inner wall of the guide section 61 and evenly distributed on the support rib 68 of the circumference of the hub 67 of the diffuser wall.

To ensure the rotation of the diffuser wall 6 around the center of the turbocharger, the supporting device further comprises an outer ring 15 of the support plate 7. An inner slot is located at each end of the hub 71 of the support plate, in which a ball bearing 17 is installed for the rotation of the connection shaft 72. The connection shaft 72 connects the hub 67 of the diffuser wall with the hub 71 of the support plate together, and supports the rotating diffuser wall 6. A locking nut 16 is set on the outer end of the connection shaft 72.

Due to the compressed air flow losses in the transmission process, and to reduce the return flow of the pressurized gas through the gap between the rotating diffuser wall 6 and the intake outline of the compressor housing 1, a seal groove 19 is set on the outer circumferential surface of the diffuser section 62 of the rotating diffuser wall 6. A sealing ring 18 is installed in the seal groove 19 to achieve the seal between the rotating diffuser wall 6 and the intake outline of the compressor housing 1.

Figure 4:
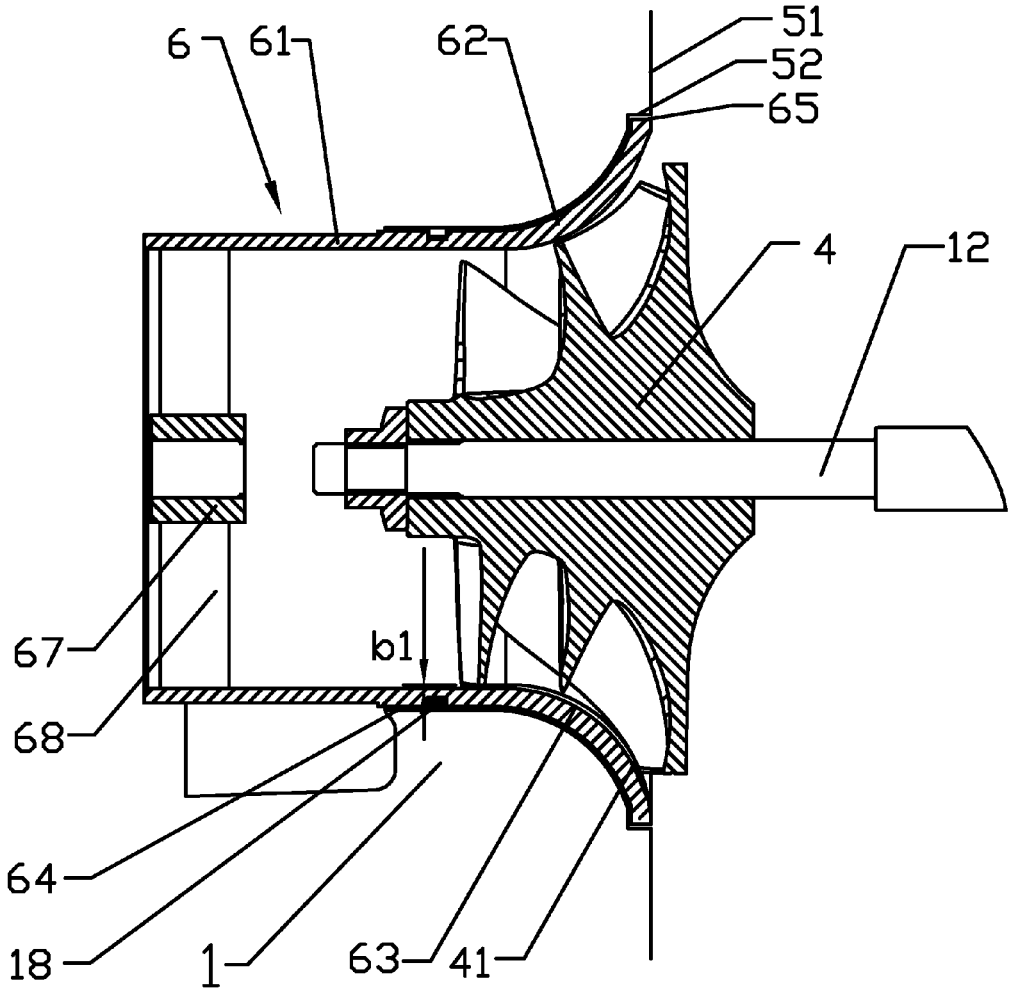
FIG. 4 is a local enlarged view of a rotating diffuser wall and a compressor impeller in FIG. 3.
Figure 5:
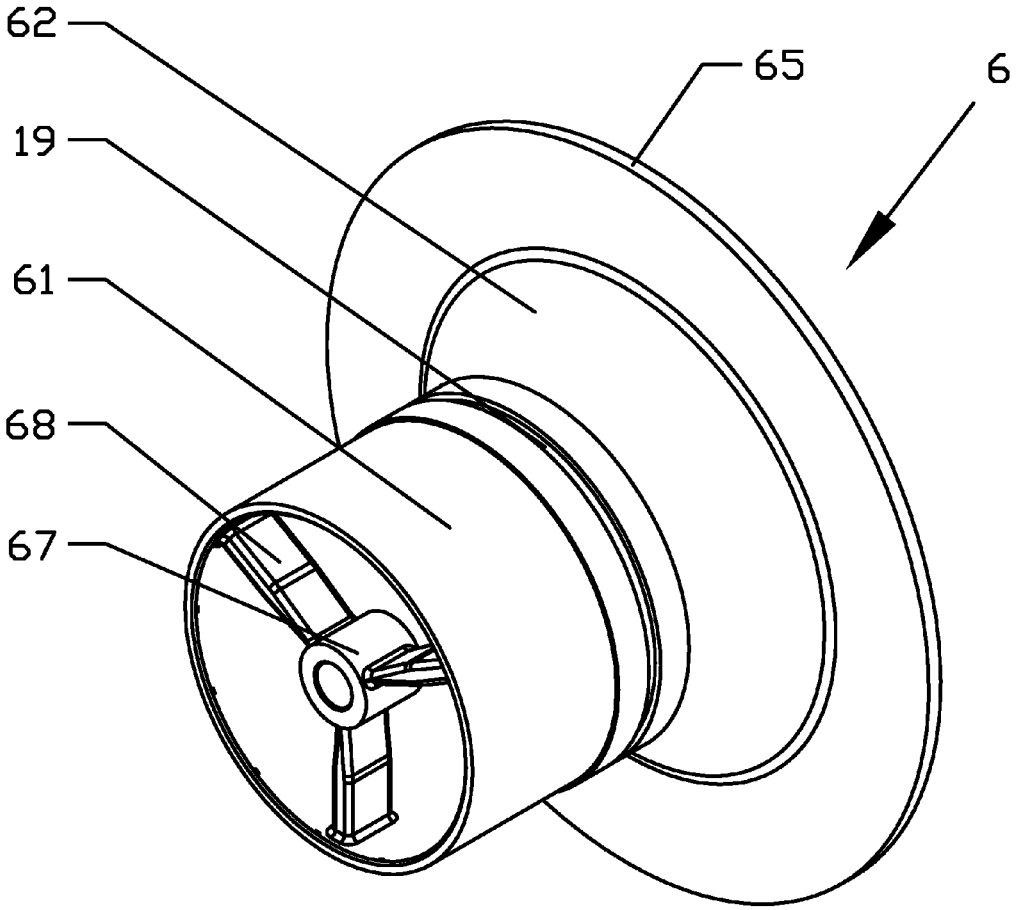
FIG. 5 is a schematic diagram of a rotating diffuser wall of Example 1.

As shown in FIG. 4 and FIG. 5, the rotating diffuser wall 6 comprises a straight-shaped guide section 61 and a horn-shaped diffuser section 62. The guide section 61 is connected with the supporting device near the end of the air inlet 2. The guide section 61 is set to improve the assembly process, and the outer diameter thereof is slightly less than the outer diameter of the junction of the diffuser section 61 and the guide section 62. In the course of operation, the compressor impeller 4 is high-speed rotating driven by the turbine shaft 12, the clean air is imported into the inside of the rotating diffuser wall 6 from the air inlet 2 of the compressor housing 1, and is compressed through the compressor impeller 4. The compressed gas enters the gas diffuser channel 5 through the exit of the compressor impeller. Thereafter, under the constraints of the diffuser channel wall 51 and the diffuser wall 11 of the connection plate, the compressed gas enters the air collection channel 3 of the compressor housing 1, and then into the engine for combustion.

The inner circumference surface 63 fitted with the diffuser wall is set on the inner surface of the diffuser section 62, and the outer contour surface 41 is set on the compressor impeller 4. The gap between the inner circumference surface 63 and the outer contour surface 41 should be less than 0.4 mm. The outer circumference surface 64 fitted with the diffuser wall is set on the outer surface of the diffuser section 62, and the gap between the outer circumference surface 64 and the inner wall of the compressor housing 1 should be less than 0.5 mm. In this example, the former gap b1 is 0.3 mm and the latter is 0.4 mm.

The diffuser channel wall 51 is set in the gas diffuser channel 5 at the corresponding side of the diffuser section 42, in which there is a circular groove 52. The maximum outer circumference surface 65 is set at the largest opening of the diffuser section 62, and it is located in the circular groove 52 and forms a smooth transition with the diffuser channel wall 51.

The diameter of the maximum outer circumference surface 65 of the diffuser section 62 is 1.05-1.5 times the maximum diameter of the compressor impeller 4. The gap between the maximum outer circumference surface 65 of the diffuser wall and the circular groove 52 is same as the gap between the outer circumference surface 64 of the diffuser wall and the inner wall of the compressor housing 1. In this example, the gap is 1.3 times the maximum diameter of the compressor impeller 4, which can ensure the adequate expansion capability in the case of the less gas flow resistance at the diffuser section 62.

Targeting at the needs of the increase of the efficiency of the turbocharger compressor and the solution for the turbocharger wear failure, the example has completed the development of the high efficient adjustable compressor with the rotating diffuser wall 6, which effectively reduces the safety gap between the traditional compressor housing 1 and the compressor impeller 4, decreases the relative speed of the compressor impeller 4 in high-speed rotation and the inner wall of the compressor housing 1 during the compress process, and greatly reduces the friction loss. This type of adjustable rotating diffuser wall compressor is simple, and can be made with the similar material and the existing casting and processing technologies.

Example 2

Figure 6:
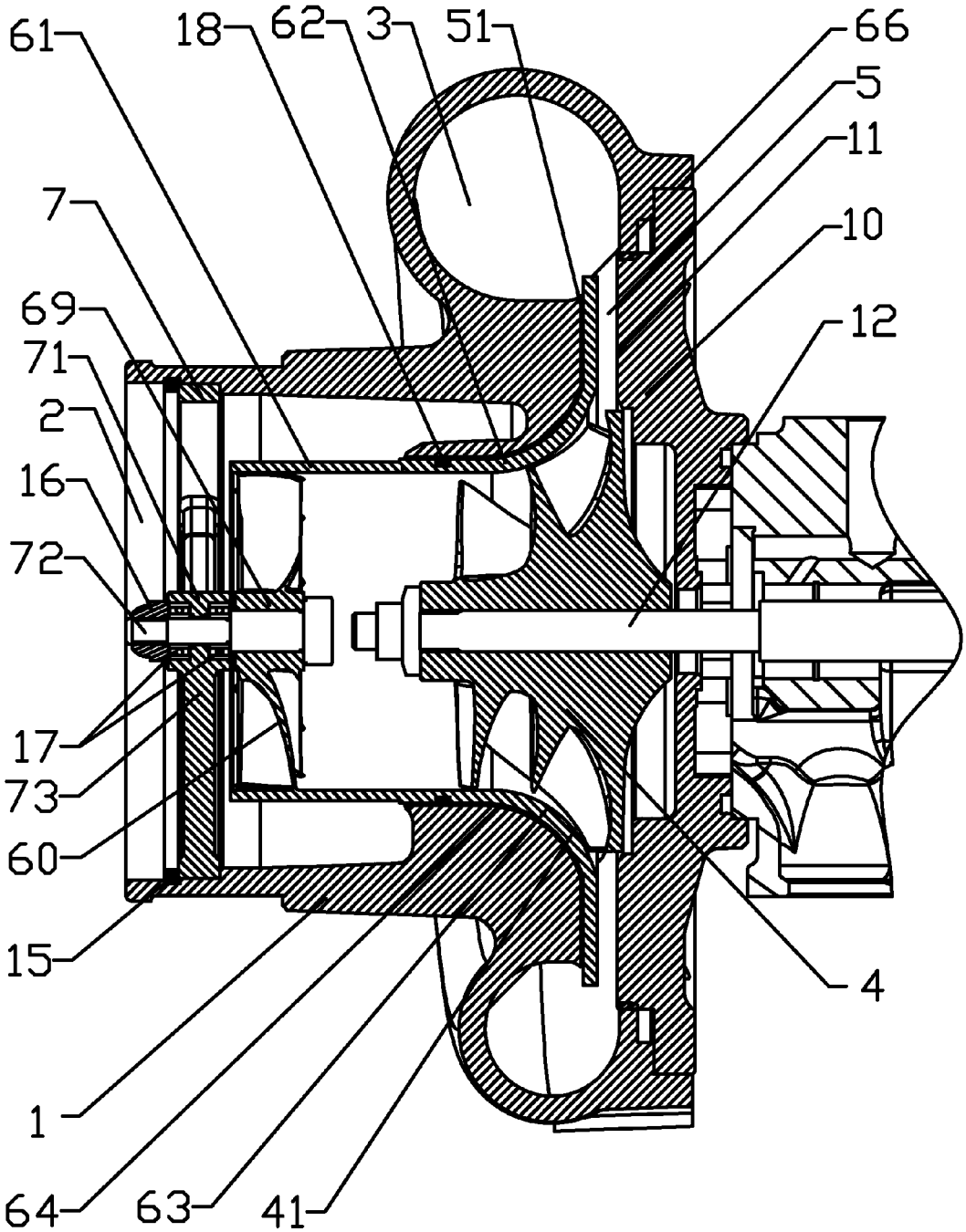
FIG. 6 is a schematic diagram of a compressor unit of a turbocharger of Example 2 of the invention.

As shown in FIG. 6, a compressor unit comprises a compressor housing 1 with an air inlet 2 and an air collection channel 3, a compressor impeller 4 is installed inside the compressor housing 1 and connected to a connection plate 10 via a turbine shaft 12, and the connection plate 10 is connected with the compressor housing 1.

An air diffuser channel 5 connected with the air collection channel 3 is located between the compressor impeller 4 and the air collection channel 3. A cylinder-shaped rotating diffuser wall 6 with the same rotation direction as the compressor impeller 4 is located between the inner wall of the compressor housing 1 and the compressor impeller 4. The supporting device for the rotating diffuser wall 6 is located in the compressor housing 1.

The supporting device comprises a support plate 7 matching with the inner wall of the air inlet 2. A hub of the support plate 71 is located at the center of the support plate 7, the connection shaft 72 is installed in the hub of the support plate 71, and the support rib 73 is located between the support plate 7 and the hub of the support plate 71.

The rotating diffuser wall 6 comprises a straight-shaped guide section 61 and a horn-shaped diffuser section 62, and the guide section 61 is connected with the supporting device near the end of the air inlet 2.

An air intake supporting device connected with the connection shaft 72 is located at the distal end of the diffuser section 62 in the guide section 61 and comprises a hub 69 of the guide vein diffuser wall at the axis center of the guide section 61. The hub 69 of the guide vein diffuser wall is fixed on the connection shaft 72, between which and the inner wall of the guide section 61, a guide vein air conditioning device is equipped.

Figure 7:
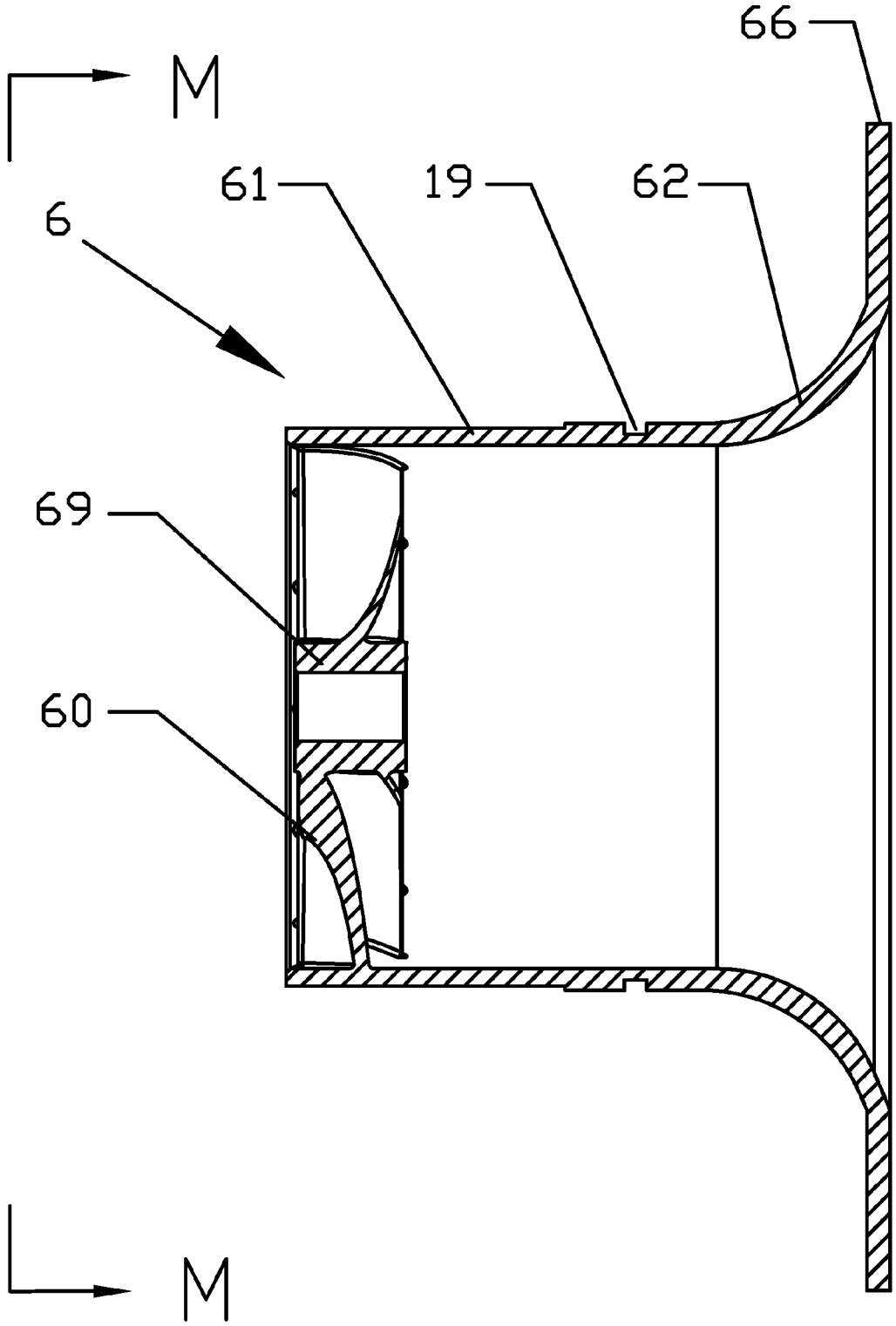
FIG. 7 is a schematic diagram of a rotating diffuser wall of Example 2.
Figure 8:
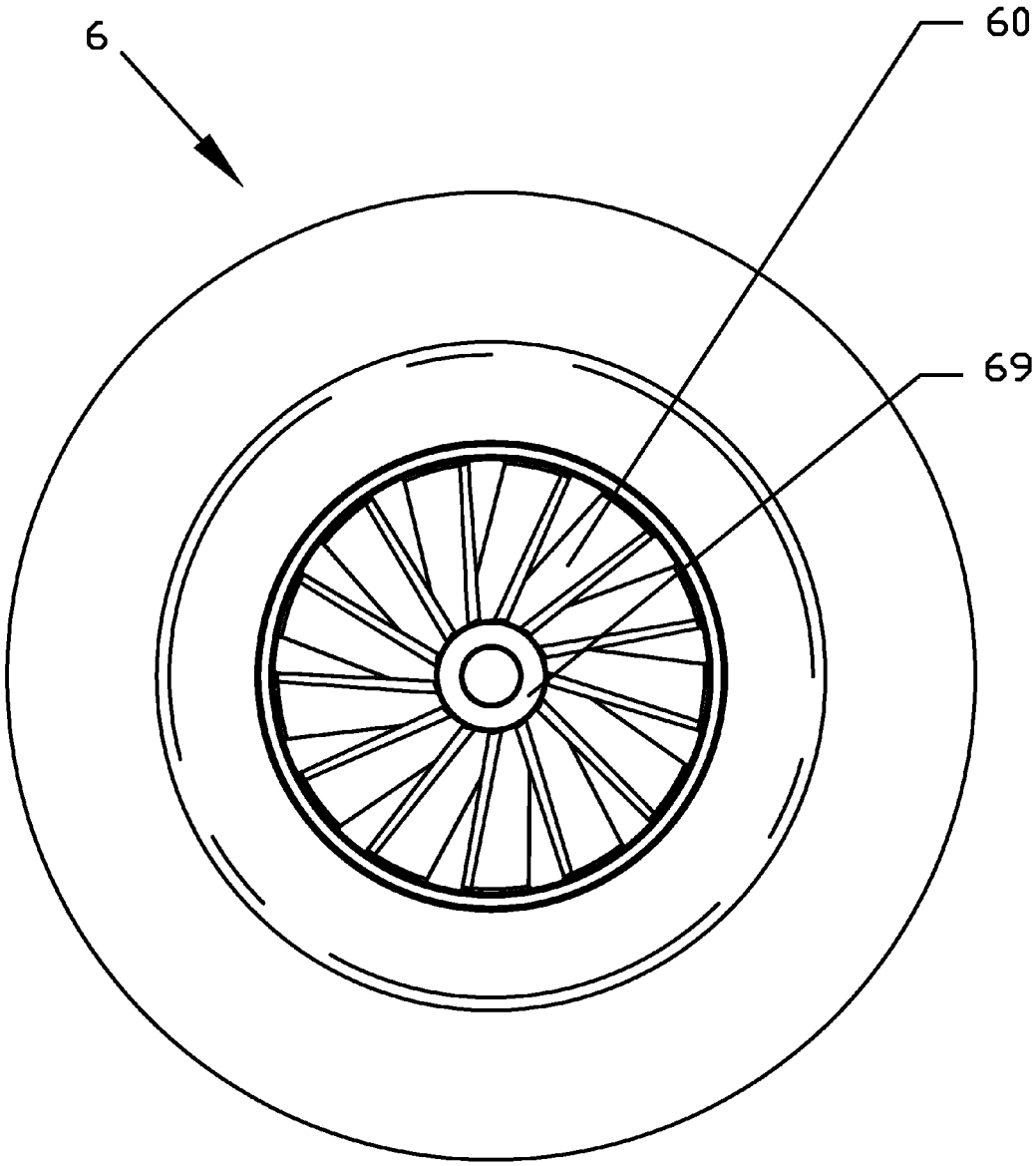
FIG. 8 is a schematic diagram taken from M-direction of FIG. 7.

As shown in FIG. 7 and FIG. 8, the difference between this example and Example 1 is in that, the guide vane air conditioning device comprises a plurality of vortex-like guide vanes 60 of the diffuser wall, which are evenly distributed on the circumference of the hub 69 of the guide vane diffuser wall. The guide vanes 60 of the diffuser wall comprise leading edges and ending edges of the guide vane blades. Their contour lines are spiral, that is, the ending edge of the leaf surface twists inside and the leading edge twists outward. This can increase the response speed of the rotating diffuser wall 6 and achieve the acceleration of the rotating diffuser wall 6 by the intake flow.

The maximum opening of the diffuser section 62 extends to the air collection channel 3 along the gas diffuser channel 5, and it has the maximum outer diameter circumferential surface 66 of the guide vane diffuser wall. The diffuser channels wall 51 is set near the inlet of the gas diffuser channel 5, and the maximum diameter circumferential surface 66 of the guide vane diffuser wall is greater than the diameter of the diffuser channel wall 51.

The maximum outer diameter of the vane diffuser wall is 1.4-2 times the maximum outer diameter of the compressor impeller 4.

To further reduce the flow loss of the pressurized gas in the gas diffuser channel 5, as a whole, the diffuser wall surface at the compressor impeller exit of the rotating diffuser wall 6 replaces the diffuser wall of the traditional compressor housing 1. To ensure the sufficient diffuser capacity and reduce air flow resistance, the diameter of the maximum circumferential surface 66 of the guide vane diffuser wall is 1.7 times the maximum diameter of the compressor impeller 4.

The rotating diffuser wall 6 is made of plastic, and can withstand temperature of 150° C. Targeting at improving the efficiency of the turbocharger compressor and solving the need of the turbocharger wear failure, the example has completed the development of the adjustable efficient compressor with the rotating diffuser wall 6. The design has speeded up the guide vanes 60 of the diffuser wall, effectively reduced the relative velocity of the compressor impeller 4 in high-speed rotation and the inner wall of the compressor housing 1, and greatly reduced the friction losses. This type of adjustable rotating diffuser wall compressor process is simple, which can be completed with the similar material and the existing casting and processing technologies.

Example 3

Figure 9:
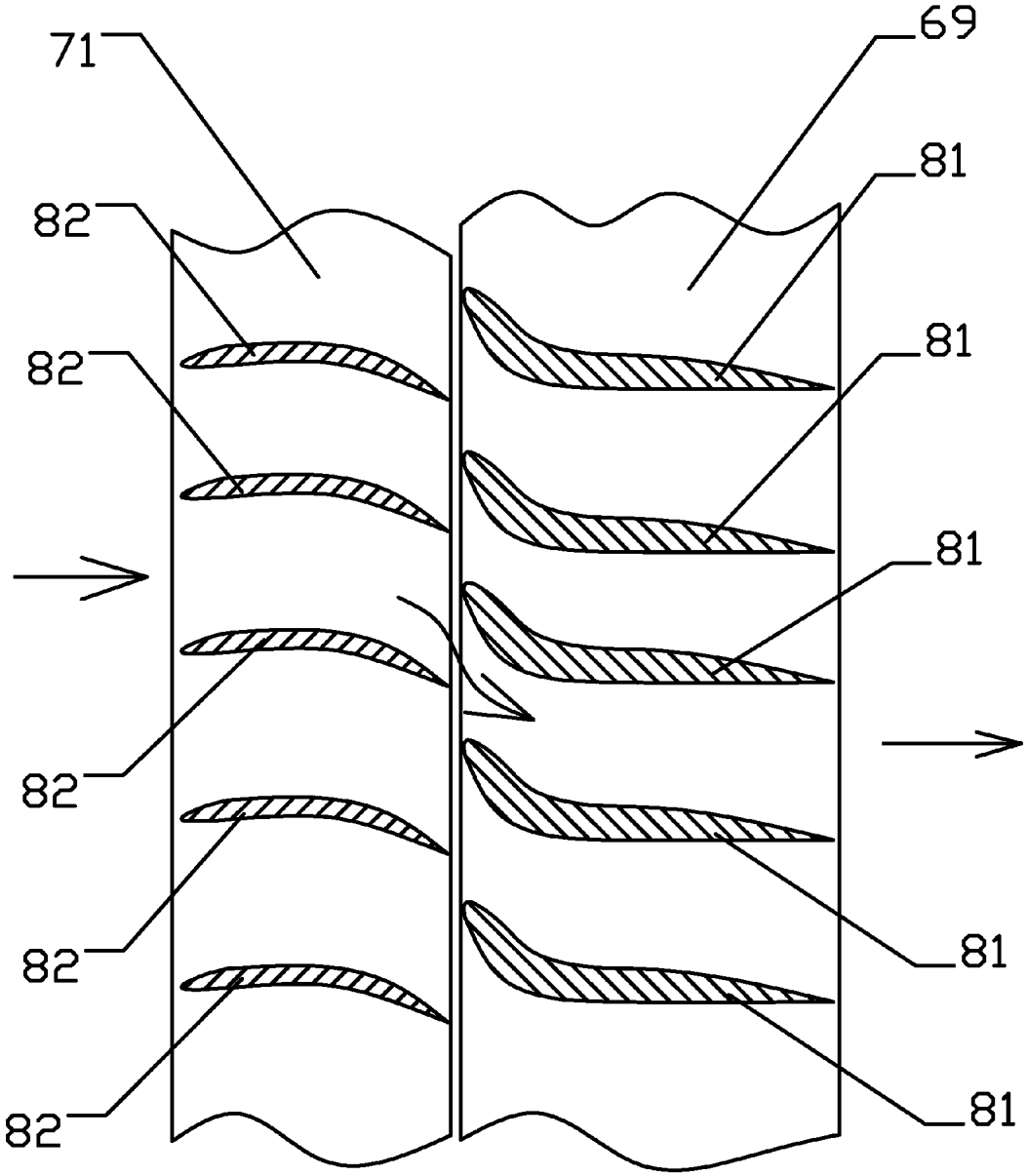
FIG. 9 is a top sectional view of moving and static guide vanes and their hubs of Example 3 of the invention.

As shown in FIG. 9, the difference between the example and Example 2 is in that; the guide vane air conditioning device comprises a plurality of moving guide vanes 81 and static guide vanes 82. The moving guide vanes 81 are installed between the hub of the guide vane diffuser wall 69 and the inner wall of the guide section 61, and the static guide vanes 82 are installed between the support plate 7 and the hub 71 of the support plate.

The moving guide vanes 81 comprise inlet leading edges and outlet trailing edges, the outlet trailing edges are level set along the axis direction, and the inlet leading edges are bending set along the rotation direction of the moving guide vanes 81.

The static guide vanes 82 comprise inlet leading edges and outlet trailing edges, the inlet trailing edges are level set along the axis direction, and the outlet leading edges are bending set with the opposite bending direction of the inlet leading edges of the moving guide vanes.

Thus, the leading edges and outlet trailing edges of the moving 81 and static guide vane 82 has formed the axial inlet channel with a reasonable flow direction, which can effectively expand the gas intake flow and achieve the purpose of the flow expansion.

Targeting at improving the efficiency of the turbocharger compressor and the need of the compressor flow expansion, the example has completed the development of the adjustable efficient compressor with the rotating diffuser wall, including the moving and static guide vanes for gas flow guide. The design of the moving and static guide vanes has efficiency expanded the compressor flow and greatly reduced the friction losses. This type of adjustable rotating diffuser wall compressor process is simple, which can be completed with the similar material and the existing casting and processing technologies.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A compressor unit, comprising:

a) a compressor housing;

b) a compressor impeller;

c) a as diffuser channel;

d) a cylinder-shaped rotating diffuser wall; and e) a supporting device;

wherein:

the compressor housing comprises an air inlet and an air collection channel;

the compressor impeller is installed in the compressor housing;

the gas diffuser channel is disposed between the compressor impeller and the air collection channel and connected to the air collection channel;

the cylinder-shaped rotating diffuser wall is disposed between an inner wall of the compressor housing and the compressor impeller and has the same rotation direction as the compressor impeller;

the supporting device is disposed in the compressor housing to support the cylinder-shaped rotating diffuser wall;

the rotating diffuser wall comprises a straight-shaped guide section and a horn-shaped diffuser section;

the guide section is connected to the supporting device at the end of the air inlet;

on the inner surface of the diffuser section disposed is an inner circumference surface fitted with the diffuser wall;

the compressor impeller comprises an outer contour surface;

there is a gap of less than 0.4 mm between the inner circumference surface fitted with the diffuser wall and the outer contour surface of the compressor impeller;

on the outer surface of the diffuser section disposed is an outer circumference surface fitted with the diffuser wall; and there is a gap of less than 0.5 mm between the outer circumference surface fitted with the diffuser wall and an inner wall of the compressor housing.

2. The compressor unit of claim 1, wherein at the side close to the diffuser section, the gas diffuser channel is disposed with a diffuser channel wall, and a circular groove is disposed on the diffuser channel wall;

a diameter of the outer circumference surface of the rotating diffuser wall is largest at the biggest opening of the diffuser section; and the largest outer circumference surface is located in the circular groove and forms a smooth transition surface with the diffuser channel wall of the gas diffuser channel.

3. The compressor unit of claim 2, wherein the diameter of the largest outer circumference surface of the rotating diffuser wall is 1.05-1.5 times the largest diameter of the compressor impeller.

4. The compressor unit of claim 3, wherein the supporting device comprises a support plate fitted with an inner wall of the inlet, a hub of the support plate is located at the center of the support plate, a connection shaft is fitted in the hub of the support plate, and a support rib plate is fitted between the support plate and its hub.

5. The compressor unit of claim 4, wherein an intake supporting device connected with the connection shaft is located in the guide section at the distal end to the diffuser section.

6. The compressor unit of claim 5, wherein the intake supporting device comprises a hub of the diffuser wall at the central axis of the guide section; the hub of the diffuser wall is fixed and installed in the connection shaft, and an air conditioning device is located between the hub of the diffuser wall and the inner wall of the guide section.

7. The compressor unit of claim 6, wherein the air conditioning device is a support rib plate of the diffuser wall distributed uniformly in the circumference of the hub of the diffuser wall.

8. The compressor unit of claim 5, wherein the intake supporting device comprises a hub of the guide vane diffuser wall at the axis center of the guide section, the hub of the guide vane diffuser wall is installed on the connection shaft, and a guide vane air conditioning device is located between the hub of the guide vane diffuser wall and the inner wall of the guide section.

9. The compressor unit of claim 8, wherein the guide vane air conditioning device comprises a plurality of vortex-like diffuser vanes evenly distributed in the circumference of the hub of the guide vane diffuser wall.

10. The compressor unit of claim 8, wherein the guide vane air conditioning device comprises a plurality of moving guide vanes and static guide vanes, the moving vanes are installed between the hub of the vane diffuser wall and the inner wall of the guide section, and the static guide vanes are installed between the support plate and its hub.

11. The compressor unit of claim 10, wherein the moving guide vanes comprise inlet leading edges and outlet trailing edges, the outlet trailing edges are level set along the axis direction, and the inlet leading edges are bending set along the rotation direction.

12. The compressor unit of claim 11, wherein the static guide vanes comprise inlet leading edges and outlet trailing edges, the inlet trailing edges are level set along the axis direction, and the outlet leading edges are bending set with the opposite bending direction of the inlet leading edges of the moving guide vanes.

13. The compressor unit of claim 1, wherein a maximum opening end of the diffuser section extends to the air collection channel along the air diffuser channel, and there is the circumferential surface with the maximum diameter of a guide vane diffuser wall at the maximum opening end of the diffuser section; and a diffuser channel wall is located near the air intake side of the air diffuser channel, and the circumferential surface with maximum diameter of the guide vane diffuser wall is greater than the outer diameter of the diffuser channel wall.

14. The compressor unit of claim 13, wherein the outer circumferential surface diameter of the guide vane diffuser wall is 1.4-2 times the diameter of the compressor impeller.

15. A compressor unit, comprising:

a) a compressor housing;

b) a compressor impeller;

c) a gas diffuser channel;

d) a cylinder-shaped rotating diffuser wall; and e) a supporting device;

wherein:

the compressor housing comprises an air inlet and an air collection channel;

the compressor impeller is installed in the compressor housing;

the gas diffuser channel is disposed between the compressor impeller and the air collection channel and connected to the air collection channel;

the cylinder-shaped rotating diffuser wall is disposed between an inner wall of the compressor housing and the compressor impeller and has the same rotation direction as the compressor impeller;

the supporting device is disposed in the compressor housing to support the cylinder-shaped rotating diffuser wall;

the rotating diffuser wall comprises a straight-shaped guide section and a horn-shaped diffuser section;

the guide section is connected to the supporting device at the end of the air inlet;

at the side close to the diffuser section, the gas diffuser channel is disposed with a diffuser channel wall, and a circular groove is disposed on the diffuser channel wall;

a diameter of the outer circumference surface of the rotating diffuser wall is largest at the biggest opening of the diffuser section; and the largest outer circumference surface is located in the circular groove and forms a smooth transition surface with the diffuser channel wall of the gas diffuser channel.

16. A compressor unit, comprising:

a) a compressor housing;

b) a compressor impeller;

c) a as diffuser channel;

d) a cylinder-shaped rotating diffuser wall; and e) a supporting device;

wherein:

the compressor housing comprises an air inlet and an air collection channel;

the compressor impeller is installed in the compressor housing;

the gas diffuser channel is disposed between the compressor impeller and the air collection channel and connected to the air collection channel;

the cylinder-shaped rotating diffuser wall is disposed between an inner wall of the compressor housing and the compressor impeller and has the same rotation direction as the compressor impeller;

the supporting device is disposed in the compressor housing to support the cylinder-shaped rotating diffuser wall;

the rotating diffuser wall comprises a straight-shaped guide section and a horn-shaped diffuser section;

the guide section is connected to the supporting device at the end of the air inlet;

a maximum opening end of the diffuser section extends to the air collection channel along the air diffuser channel, and there is the circumferential surface with the maximum diameter of a guide vane diffuser wall at the maximum opening end of the diffuser section; and a diffuser channel wall is located near the air intake side of the air diffuser channel, and the circumferential surface with maximum diameter of the guide vane diffuser wall is greater than the outer diameter of the diffuser channel wall.

* * * * *